US006189154B1

(12) United States Patent
Ducharme

(10) Patent No.: US 6,189,154 B1
(45) Date of Patent: Feb. 20, 2001

(54) HIDDEN IMPLEMENT HOLDER SYSTEM

(76) Inventor: Bill E. Ducharme, 1922 E. Weldon Ave., Phoenix, AZ (US) 85016

( * ) Notice: Under 35 U.S.C. 154(b), the term of this patent shall be extended for 0 days.

(21) Appl. No.: 09/317,453

(22) Filed: May 24, 1999

(51) Int. Cl.[7] ..... A41F 3/02

(52) U.S. Cl. ..... 2/338; 2/247; 224/664; 224/679; 224/235; 224/231

(58) Field of Search ..... 2/338, 311–319, 2/321–322, 170, 247, 220, 44, 92, 279; 224/663, 664, 679, 684, 231, 235, 245

(56) References Cited

U.S. PATENT DOCUMENTS

| | | | | |
|---|---|---|---|---|
| 648,267 | * | 4/1900 | Koch | 2/338 |
| 683,790 | * | 10/1901 | Parmenter | 2/247 |
| 891,977 | * | 6/1908 | Bloch | 2/247 |
| 2,914,070 | | 11/1959 | Kellner et al. . | |
| 3,919,615 | * | 11/1975 | Nieke | 224/23 |
| 4,113,157 | * | 9/1978 | Woodbury | 224/26 E |
| 4,472,839 | | 9/1984 | Johansen . | |
| 4,525,879 | | 7/1985 | Kalomeris . | |
| 5,009,222 | * | 4/1991 | Her | 128/36 |
| 5,173,969 | | 12/1992 | Fredrickson . | |
| 5,232,031 | * | 8/1993 | Freickson | 144/380 |
| 5,318,084 | | 6/1994 | Jackson . | |
| 5,374,919 | | 12/1994 | Zelka et al. . | |
| 5,397,040 | | 3/1995 | Lee . | |
| 5,499,401 | * | 3/1996 | Heinmiller | 2/208 |
| 5,500,952 | * | 3/1996 | Keyes | 2/455 |
| 5,511,703 | | 4/1996 | Ryerson . | |
| 5,611,084 | * | 3/1997 | Garry et al. | 2/44 |
| 5,693,006 | | 12/1997 | Slautterback . | |
| 5,928,275 | * | 7/1999 | Yates et al. | 607/112 |

FOREIGN PATENT DOCUMENTS

| | | | | |
|---|---|---|---|---|
| 2806918 | * | 3/1979 | (DE) | 2/247 |
| 2404443 | * | 6/1979 | (FR) | 2/247 |

OTHER PUBLICATIONS

Simplicity Catalogue, p. 1484, Oct. 1992.*

* cited by examiner

*Primary Examiner*—John J. Calvert
*Assistant Examiner*—Tejash Patel
(74) *Attorney, Agent, or Firm*—Weiss & Moy, P.C.; Jeffrey Weiss; Jeffrey D. Moy

(57) ABSTRACT

A hidden implement holder system. The hidden implement holder system comprises; a cummerbund article; and an implement compartment coupled to and concealed by the cummerbund. The cummerbund article further comprises an implement holder contained within the implement compartment, and the implement compartment further comprises a closeable access coupled thereto. The implement holder is comprised of a vertically stabilized rigid material, having horizontal flexibility, and having a set of implement cavities thereon, and additionally comprises a set of implements positioned within the set of implement cavities.

7 Claims, 2 Drawing Sheets

HIDDEN IMPLEMENT HOLDER SYSTEM

BACKGROUND OF THE INVENTION

1. Field of the Invention

This invention is in the field of implement holders, and more particularly, is a system for a cummerbund that holds implements while simultaneously concealing them from view, and also providing vertical stabilization of the cummerbund.

2. Description of the Related Art

In the hospitality profession a standard item of apparel is a cummerbund, or similar article. A cummerbund is a wide sash with horizontal pleats worn at the waist. More generally, a cummerbund is also defined as any shawl or sash worn at the waist, especially by men in India. The cummerbund is generally worn beneath a dinner jacket by guests or attendees to formal events, and is also worn as an accessory by hospitality professionals. Hospitality professionals include, without being limited to, bartenders, bussing staff, waiters, waitresses, maitre'ds, hospitality managers, etc. Hospitality professionals often wear a cummerbund as it presents a neat, well-ordered appearance, and serves to keep the front of the shirt and pants, particularly around the waist, looking professional and dapper. Hospitality professionals in the course of their duties have need of implements, or working tools, to: remove bottle tops and corks; light cigarettes and cigars for guests; trim cigars for guests; supply writing instruments when asked; etc. Therefore, the hospitality professional must keep these and other tools of their trade at hand. This becomes even more important as the level of event formality or the stature of the event guests increases. Until now, hospitality professionals had to carry their working tools in their shirt pockets, in their pants pockets, etc. Placing these tools in their shirt or pants pockets creates an unsightly appearance as the pockets become distended, and the pockets more easily pick up stains and dirt due to brushing dirty surfaces. The constant access to the tools also causes the pockets areas to become soiled quickly by the user's hands. A further problem is that some tools may not even fit easily into pockets, or the number of tools will exceed the space available in the clothing pockets.

Therefore, a need existed for a system of carrying a variety of hospitality professional's implements in a concealed manner to maintain the hospitality worker's appearance dapper. Additionally, a need existed for a system for carrying a variety of hospitality professional's implements in a manner that would allow easy access by the hospitality worker. A further need existed for a system for carrying a variety of hospitality professional's implements in a manner that would minimize the problem of soiling the hospitality professional's clothing problem due to removing and replacing the implements during use, and minimize contact soiling due to distended pockets. Yet another need existed for a system for easily carrying a variety of hospitality professional's implements not easily carried in the pockets of the hospitality professional.

SUMMARY OF THE INVENTION

An object of the present invention is to provide a system of carrying a variety of hospitality professional's implements in a concealed manner to maintain the hospitality worker's appearance dapper.

Another object of the present invention is to provide a system for carrying a variety of hospitality professional's implements in a manner that would allow easy access by the hospitality worker.

Yet a further object of the present invention is to provide a system for carrying a variety of hospitality professional's implements in a manner that would minimize the problem of soiling the hospitality professional's clothing problem due to removing and replacing the implements during use, and minimize contact soiling due to distended pockets.

An additional object of the present invention is to provide a system for easily carrying a variety of hospitality professional's implements not easily carried in the pockets of the hospitality professional.

BRIEF DESCRIPTION OF THE PREFERRED EMBODIMENTS

In accordance with one embodiment of the present invention, a hidden implement holder system is disclosed. The hidden implement holder system comprises; a cummerbund article and an implement compartment coupled to and concealed by the cummerbund.

In accordance with another embodiment of the present invention, an internal hidden implement holder and cummerbund appearance maintenance system is disclosed. The internal hidden implement holder and cummerbund appearance maintenance system comprises; a cummerbund article; and a vertically stabilized implement compartment coupled to the cummerbund.

The foregoing and other objects, features, and advantages of the invention will be apparent from the following, more particular, description of the preferred embodiments of the invention, as illustrated in the accompanying drawings.

DESCRIPTION OF THE PREFERRED EMBODIMENTS

Figure 1:
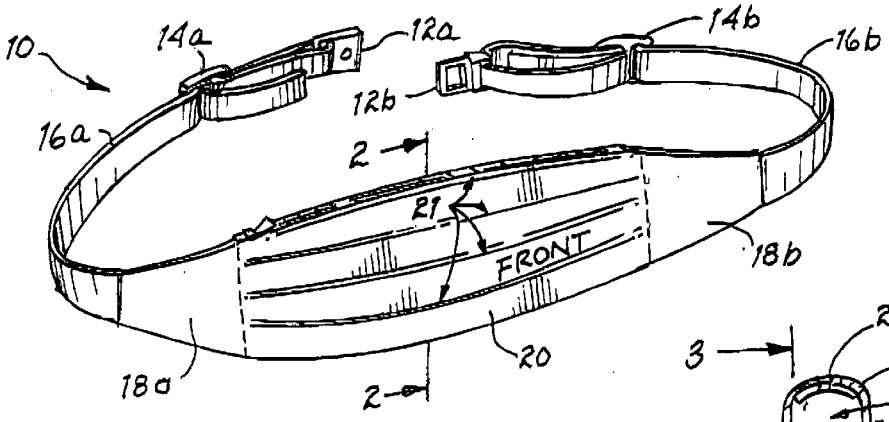
FIG. 1 is a elevated perspective view, of the hidden implement holder system of the present invention with the implement compartment closed.

Referring to FIG. 1, an elevated perspective view of the hidden implement holder system (the "system 10" hereinafter) of the present invention is shown. The system 10 comprises a cummerbund article of wearing apparel. A cummerbund is worn in the hospitality profession as a standard item of wearing apparel or uniform. A cummerbund is a wide sash with horizontal pleats worn about the waist. More generally, a cummerbund is also defined as any shawl or sash worn at the waist, especially by men in India. Hospitality professionals often wear a cummerbund as it presents a neat, well-ordered appearance, and serves to keep the shirt front and pants, particularly around the waist, looking professional and dapper.

In a preferred embodiment, the system 10, in general, comprises a cummerbund sash 20, featuring a plurality of horizontal pleats 21, the sash end pieces 18*a* and *b,* the cummerbund support straps 16*a* and *b,* support strap length adjustment buckles 14*a* and *b,* and the cummerbund clasps 12*a* and *b.* A user places the system 10 around their waist in a manner well known to users of cummerbunds (wearing method not shown herein) with the cummerbund sash 20 at the front of the user's waist, the cummerbund clasps 12*a* and *b* are fastened together, and the support strap length adjustment buckles 14*a* and *b* adjusted for a comfortable fit around the user's waist. The cummerbund sash 20 further comprises a pouch 25 (See FIG. 2.) The pouch 25 also comprises a closure at the top of the cummerbund sash 20. In a preferred embodiment, the closure is a zipper 22, though other closures may be used. Other closures, for example may be, without being limited to, hook and loop fasteners, buttons, snaps, etc. Examining the system 10 shown in FIG. 1, the zipper 22 may be observed along the top of the cummerbund sash 20. The zipper 22 has it's zipper pull 24 located to the user's right in a preferred embodiment when the zipper 22 is in the closed position, though those skilled in the art will realize that the zipper 22 may be attached so as to place the zipper pull at either the left or the right when in the closed position depending on the preferences of the user or the manufacturer.

Figure 2:
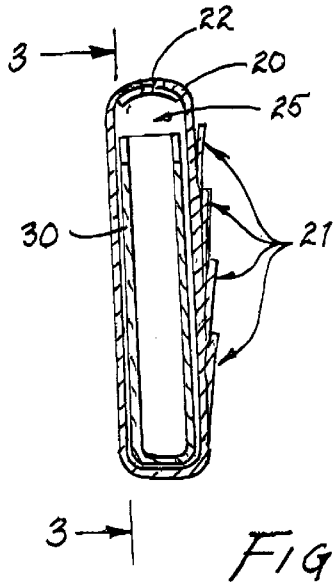
FIG. 2 is a side cut-away view along the line 2—2 of FIG. 1 of the hidden implement holder system of the present invention.
Figure 5:
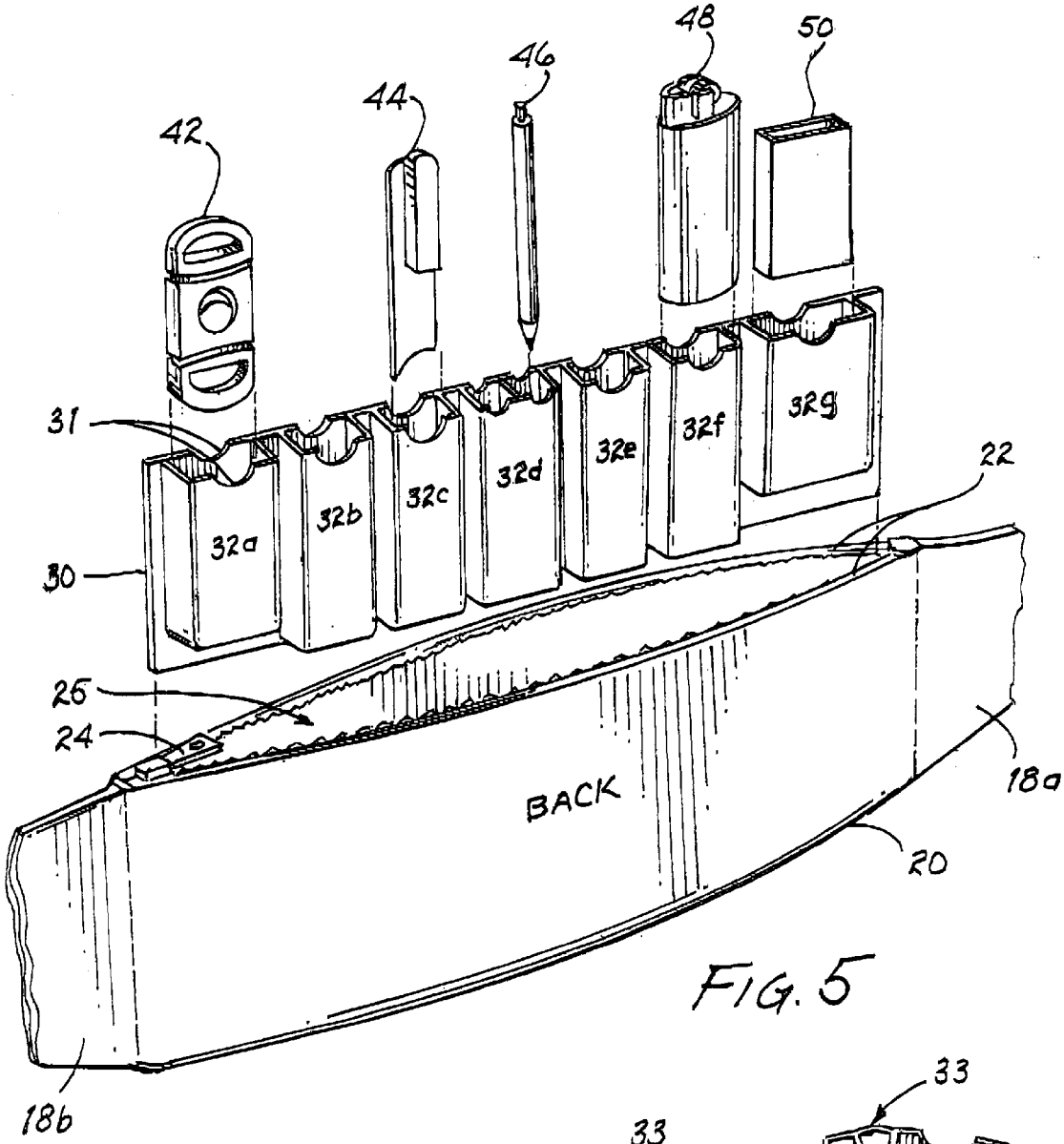
FIG. 5 is an exploded back perspective view, of the hidden implement holder system of the present invention.

Referring to FIG. 2, a side cut-away view along the line 2—2 of FIG. 1 of the system 10 of the present invention is shown. In a preferred embodiment, the cummerbund sash 20 has within its confines the pouch 25. However, in an alternate embodiment (not shown herein), the pouch 25 may be a separate item coupled to and behind the cummerbund sash 20. This alternate embodiment would allow the use of multiple cummerbunds with a single pouch 25 thereby more easily allowing the cleaning and care of the cummerbund sash 20. Retuning to a preferred embodiment as shown in FIG. 2, placed within the pouch 25 is an implement holder/cummerbund reinforcement 30. The implement holder/cummerbund reinforcement 30 is placed within the pouch 25 and when the zipper 22 is in the zipped, or closed position, the implement holder/cummerbund reinforcement 30 is not visible to proximate people. Referring to FIG. 5, a back perspective and exploded view, of the system 10 is shown. In this exploded view, the implement holder/cummerbund reinforcement 30 is shown removed from the pouch 25. Additionally, the pouch 25 is open with the zipper pull 24 shown in the open position. Also shown in FIG. 5 are exemplary implements 42, 44, 46, 48, and 50 above their receiving implement cavities 32*a,* 32*c,* 32*d,* 32*f* and 3*g* respectively. The exemplary implements shown herein are:

| Item Number | Implement |
|---|---|
| 42 | Cigar Cutter |
| 44 | Cork Screw / Bottle Cap Remover |
| 46 | Pen / Pencil |
| 48 | Lighter |
| 50 | Box of matches |

The exemplary implements 42–50 are not meant to be limiting, but are merely exemplary of the many different implements useable with the system 10. Further examples of implements (not shown herein) comprise, without being limited to; books of matches, pen knifes, crumb scoops, candle trimmers, nail files, fingernail clippers, etc.

Figure 3:
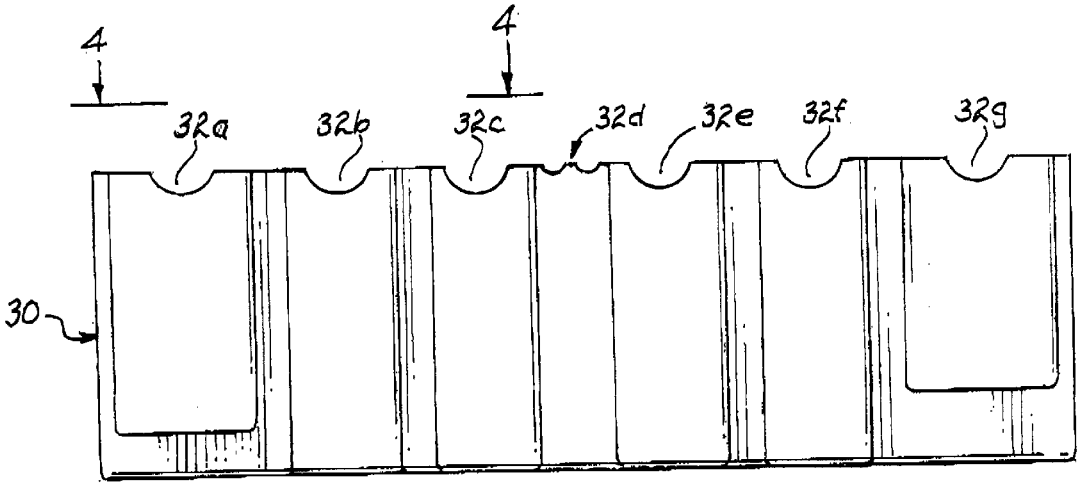
FIG. 3 is a front view of the implement holder/cummerbund reinforcement of the hidden implement holder system of the present invention.

Referring to FIG. 3 a front view of the implement holder/cummerbund reinforcement 30 of the system 10 of the present invention is shown. In a preferred embodiment the implement holder/cummerbund reinforcement 30 is comprised of a set of implement cavities 32*a–g,* as previously mentioned, for holding or storing the implements, or tools of the trade, of the user, a hospitality professional. Each of the implement cavities 32*a–g* are designed to fit a variety of implements. In a preferred embodiment the implement cavities 32*a–g* are sized for specific implements that are generic in nature. i.e. a standard BIC™ lighter, a standard cigar cutter etc. However those skilled in the art will realize that a designer or manufacturer would easily be able to select their own desired implements and size the implement cavities 32*a–g* accordingly, including varying the number of, size, shape and design of the implement cavities 32, or the material thereof, as either desired or necessary.

Figure 4:
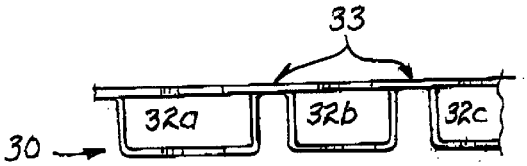
FIG. 4 is a top view of three of the implement cavities of the implement holder/cummerbund reinforcement looking down along line 4—4 of FIG. 3.
Figure 6:
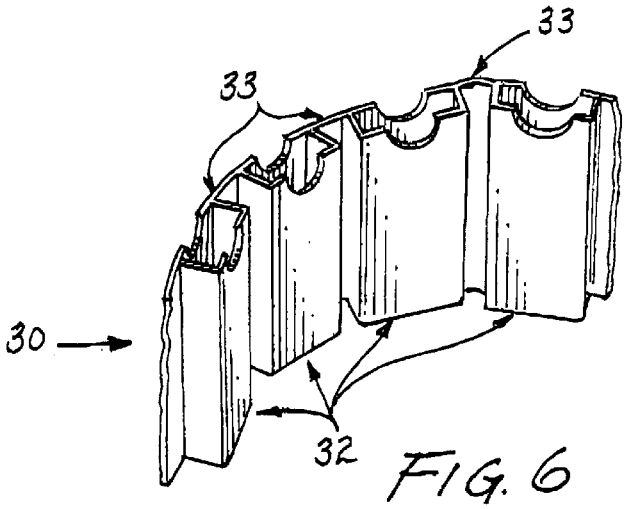
FIG. 6 is a back perspective view of the implement holder/cummerbund reinforcement showing the flexibility of the hidden implement holder system.

Referring to FIG. 4 a top view of the implement cavities 32*a–g* of the implement holder/cummerbund reinforcement 30 looking down along line 4—4 of FIG. 3 is shown. This view shows that in a preferred embodiment the construction of the implement holder/cummerbund reinforcement 30 of the system 10 comprises interstitial spacing 33 between the implement cavities 32. This interstitial spacing 33 is a feature that allows the implement holder/cummerbund reinforcement 30 of the system 10 to be horizontally flexible while remaining vertically rigid. The horizontal flexibility is shown in FIG. 6 which shows a back perspective view of the implement holder/cummerbund reinforcement 30. As shown, the implement holder/cummerbund reinforcement 30 will flex along a horizontal axis thus allowing the cummerbund sash 20, into which the implement holder/cummerbund reinforcement 30 is inserted, to conform to the waist of the user of the system 10. Additionally, the implement cavities 32*a–g* will maintain the vertical aspect of the implement holder/cummerbund reinforcement 30 substantially linear thereby maintaining a smooth vertical appearance of the cummerbund sash 20 and pleats 21.

Although the invention has been particularly shown and described with reference to a preferred embodiment thereof, it will be understood by those skilled in the art that changes in form and detail may be made therein without departing from the spirit and scope of the invention.

What is claimed is:

1. A hidden implement holder system, comprising, in combination:

a cummerbund article;

wherein said cummerbund article comprises a plurality of horizontal pleats located on a front portion thereof so as to have the appearance of a cummerbund of the type wearable beneath a formal dinner jacket; and an implement compartment coupled to and concealed by said front portion of said cummerbund and an implement holder contained within said implement compartment and having a set of implement cavities thereon which provides horizontal flexibility.

2. The system of claim 1 further comprising a closeable access coupled to said implement compartment.

3. The system of claim 2 further comprising a set of implements positioned within said set of implement cavities.

4. The system of claim 3 wherein said implement holder is comprised of a vertically stabilized rigid material, having horizontal flexibility.

5. The system of claim 1 further comprising a closeable access coupled to said implement compartment.

6. The system of claim 1 further comprising a set of implement cavities comprised of a vertically stabilized rigid material, having horizontal flexibility.

7. The system of claim 1 further comprising a set of implements positioned within a set of implement cavities.

* * * * *